US007581363B2

(12) United States Patent
Mawby et al.

(10) Patent No.: US 7,581,363 B2
(45) Date of Patent: Sep. 1, 2009

(54) METHOD FOR CONSTRUCTING A MULTISTORY BUILDING

(76) Inventors: Walter H. Mawby, 7952 Briar Brook Ct., Dallas, TX (US) 75218-4514; Britten L. Perkins, 8014 Highmeadow Dr., Houston, TX (US) 77063-4720

( * ) Notice: Subject to any disclaimer, the term of this patent is extended or adjusted under 35 U.S.C. 154(b) by 332 days.

(21) Appl. No.: 09/902,023

(22) Filed: Jul. 10, 2001

(65) Prior Publication Data

US 2003/0205022 A1 Nov. 6, 2003

Related U.S. Application Data

(60) Provisional application No. 60/273,374, filed on Mar. 5, 2001.

(51) Int. Cl.
*E04H 6/00* (2006.01)

(52) U.S. Cl. ..... 52/236.5; 52/236.6; 52/236.7

(58) Field of Classification Search ..... 52/745.03, 52/236.3, 236.5, 236.8, 79.11, 125.1, 125.4, 52/125.5, 125.6

See application file for complete search history.

(56) References Cited

U.S. PATENT DOCUMENTS 1,432,132 A * 10/1922 Sturges ..... 52/175
2,049,088 A * 7/1936 Singer ..... 52/185
2,241,830 A * 5/1941 tourtellote ..... 52/169.4
3,676,536 A * 7/1972 Shelley ..... 249/1
3,812,637 A * 5/1974 Yang et al. ..... 52/236.8
3,812,679 A * 5/1974 Ruemmele ..... 405/138
3,835,601 A * 9/1974 Kelbish ..... 52/79.2
3,882,649 A * 5/1975 Mah et al. ..... 52/236.5
3,894,373 A * 7/1975 Willingham ..... 52/236.3
3,897,662 A * 8/1975 Fencl ..... 52/79.2
3,970,200 A * 7/1976 Goetjen ..... 414/11
3,979,919 A 9/1976 Blonde et al. ..... 61/45
3,990,193 A * 11/1976 Ray et al. ..... 52/745.03
4,073,148 A * 2/1978 Zaretti ..... 405/287
4,078,345 A * 3/1978 Piazzalunga ..... 52/236.9
4,127,254 A * 11/1978 Kahan ..... 249/181
4,136,492 A * 1/1979 Willingham ..... 52/30
4,261,542 A 4/1981 Lefebvre ..... 249/11
4,407,609 A * 10/1983 Cerutti et al. ..... 405/146
4,417,831 A * 11/1983 Abbott et al. ..... 114/293
4,439,064 A 3/1984 van der Gaarden ..... 405/150
4,465,257 A * 8/1984 Schimmel ..... 249/11
4,679,374 A * 7/1987 Boehmig ..... 52/745.03

(Continued)

OTHER PUBLICATIONS

EDI Brochure, *Tunnelform*, Dec. 10, 2000 (8 p.).

*Primary Examiner*—J. Allen Shriver
*Assistant Examiner*—Steven Marsh
(74) *Attorney, Agent, or Firm*—Conley Rose, P.C.

(57) ABSTRACT

A multistory concrete building formed entirely of poured in place concrete tunnels and method of making same. The structure is constructed so that the substructure can be used as a parking garage and the superstructure as residential space. The unique use of concrete tunnels in both the substructure and superstructure combines the benefits of column and plate construction with concrete tunnel construction while eliminating the need for a traditional transfer deck between the superstructure and substructure. In one embodiment, the parking structure is constructed from tunnel walls of alternating lengths such that the drive aisle in certain walls can be extended so as to allow additional parking spaces to be formed in the planes of those walls.

13 Claims, 5 Drawing Sheets

U.S. PATENT DOCUMENTS 4,759,158 A * 7/1988 Aubry ..... 52/79.2
4,907,910 A * 3/1990 Teron ..... 405/132
5,040,921 A * 8/1991 Torok ..... 405/150.1
5,219,451 A * 6/1993 Datta et al. ..... 405/203
5,403,124 A * 4/1995 Kocaman et al. ..... 405/204
5,809,704 A * 9/1998 Stewart et al. ..... 52/169.4
6,405,496 B1 * 6/2002 Stewart et al. ..... 52/169.3
6,550,197 B1 * 4/2003 Gray ..... 52/236.3

* cited by examiner

3RD FLOOR PLAN

METHOD FOR CONSTRUCTING A MULTISTORY BUILDING

CROSS-REFERENCE TO RELATED APPLICATIONS

The present application claims the benefit of U.S. Provisional Application Ser. No. 60/273,374, filed Mar. 5, 2001, entitled Method for Constructing a Multistory Building, which is incorporated herein by reference.

STATEMENT REGARDING FEDERALLY SPONSORED RESEARCH OR DEVELOPMENT

Not applicable.

BACKGROUND OF THE INVENTION

The present invention relates to a method for constructing a building using poured-in-place concrete-tunnel construction methods. The present invention is especially applicable to buildings having a distinct superstructure and substructure. More particularly, the present invention provides a method for constructing such a building without the need for a load transfer deck. Still more particularly, the present invention relates to a method for spacing and extending load-bearing walls in the superstructure and the substructure such that load-bearing members in both structures are vertically aligned.

Construction of buildings using tunnel forming has been utilized for many years in the construction of multistory concrete buildings. Tunnel forming allows the walls and floor of a certain level of the building to be poured simultaneously. This method greatly reduces the costs associated with multistory concrete construction. There are many structures used in the tunnel forming process, such as those that are described in U.S. Pat. Nos. 4,439,064, 4,261,542, and 3,979,919, each of which is incorporated herein by reference.

When designing and constructing multistory structures it is often desired to incorporate several levels of parking spaces into the structure. As an example, it has become commonplace to construct buildings in which several floors of residential units are constructed above some number of floors of parking garage. The architect or designer must take into account the load bearing requirements of both the parking garage and of the residential units. The limitations on the arrangement of load-bearing members in a parking garage are very different from the limitations on the arrangement of load-bearing members in a series of residential units.

Parking garages must typically provide accessible parking spaces in units that are approximately equal to an integral multiple of a standard car width. In order to avoid excess costs associated with larger spans, the integral multiple is typically small, e.g. two or three. Thus, relatively inexpensive parking garages will have parking bays that are two or three car widths wide. In addition, wide access lanes are needed to allow cars to enter and exit the parking spaces. In addition, it is often desirable for security reasons to allow transverse visual access to the parking bays. Thus, there are several mechanical, cost, security, and other constraints on the positioning of vertical load-bearing members in a parking garage.

At the same time, it is often desirable to configure residential units in a manner that is not constrained by the configuration of the load-bearing members in levels below the residential unit. If the layout of the load-bearing members in the residential structure does not vertically align with the layout of the load-bearing members in the underlying parking structure, it is necessary to provide a transfer deck.

Transfer decks are well known in the art and comprise rigid planar structures that allow vertical loads to be transferred from load-bearing members on one side of the transfer deck to non-vertically-aligned load-bearing members on the other side of the transfer deck. Because the transfer deck is subjected to very large shear and bending forces, it is typically quite massive and therefore expensive.

A primary objective of one embodiment of the present invention is to eliminate the transfer deck therefore decreasing costs of construction.

Another objective of one embodiment of the present invention is to provide advantageous layouts to both a parking garage and to residential units while keeping load-bearing members in vertical alignment.

Yet another objective of one embodiment of the present invention is to reduce the costs associated with construction of a building that integrates a substructure and a superstructure with substantially different configurations.

Still another objective of the present invention is to provide a building system in which the substructure and the superstructure utilize the same construction methods and materials (forms), thus further reducing costs and time of construction and making it possible for a single work team to construct the entire building.

SUMMARY OF THE INVENTION

According to a preferred embodiment, a multistory building can be built without a transfer deck even when it is desired to provide very different configurations in the substructures and superstructures. For example, in the case of a building having a parking garage as its substructure and residential units as its superstructure, the present invention makes it possible to avoid the expense of a transfer deck, while providing desirable residential configurations and a maximum number of parking units per unit area.

The present invention makes it possible to provide advantageous layouts to both a parking garage and to residential units while keeping load-bearing members in vertical alignment. The present invention also provides a building system in which the substructure and the superstructure utilize the same construction methods and materials (forms), thus further reducing costs and time of construction and making it possible for a single work team to construct the entire building.

In a preferred embodiment of the present invention, the load-bearing members in the residential structure (hereinafter "upper load-bearing members") are aligned vertically, as is well known in the art. At the same time, load-bearing members in the parking structure (hereinafter "lower load-bearing members") are vertically aligned with the upper load-bearing members. However, instead of providing continuous support along the length of each upper load-bearing member, the lower load-bearing members are configured to provide columnar support. Correspondingly, the upper structure is provided with an interface level as its lowest level. The load-bearing members at the interface level are configured to span the columnar supports provided by the lower load-bearing members. In this manner, the present invention provides the versatility of a column-and-plate structure (such as is provided by a transfer deck), but at the lower cost of a load-bearing system.

BRIEF DESCRIPTION OF THE DRAWINGS

For an introduction to the detailed description of the preferred embodiments of the invention, reference is made to the following accompanying drawings wherein.

DETAILED DESCRIPTION OF THE PREFERRED EMBODIMENTS

The present invention provides for the vertical transmission of loads through a superstructure and into a substructure while allowing both the sub- and superstructures to be configured in a cost effective and desirable manner. In addition, the present invention eliminates the need for a transfer deck, thereby significantly reducing the cost of structures built according to the invention.

Figure 1:
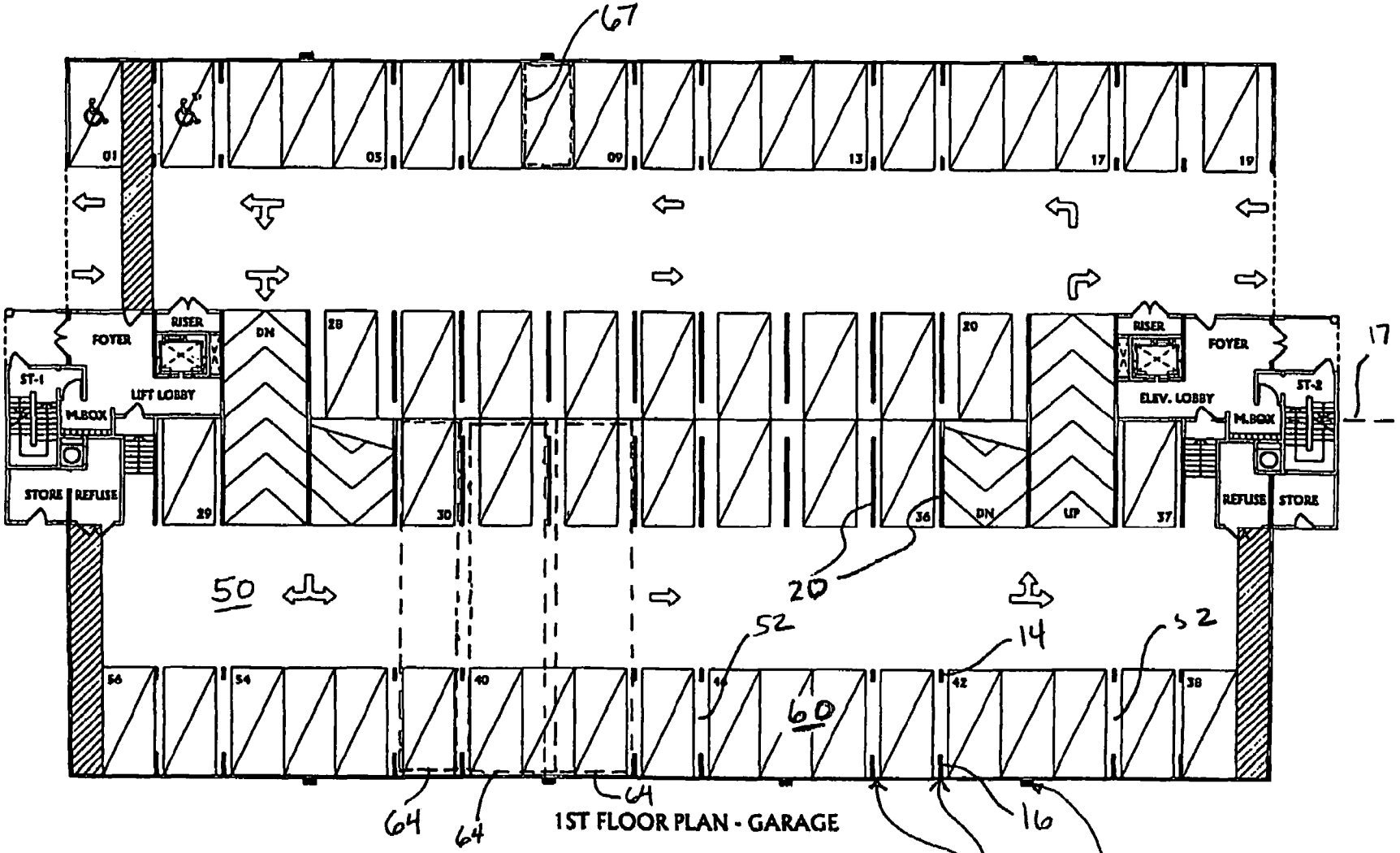
FIG. 1 is a plan view of a representative first floor of a building having a substructure configured as a garage and constructed in accordance with the present invention.
Figure 2:
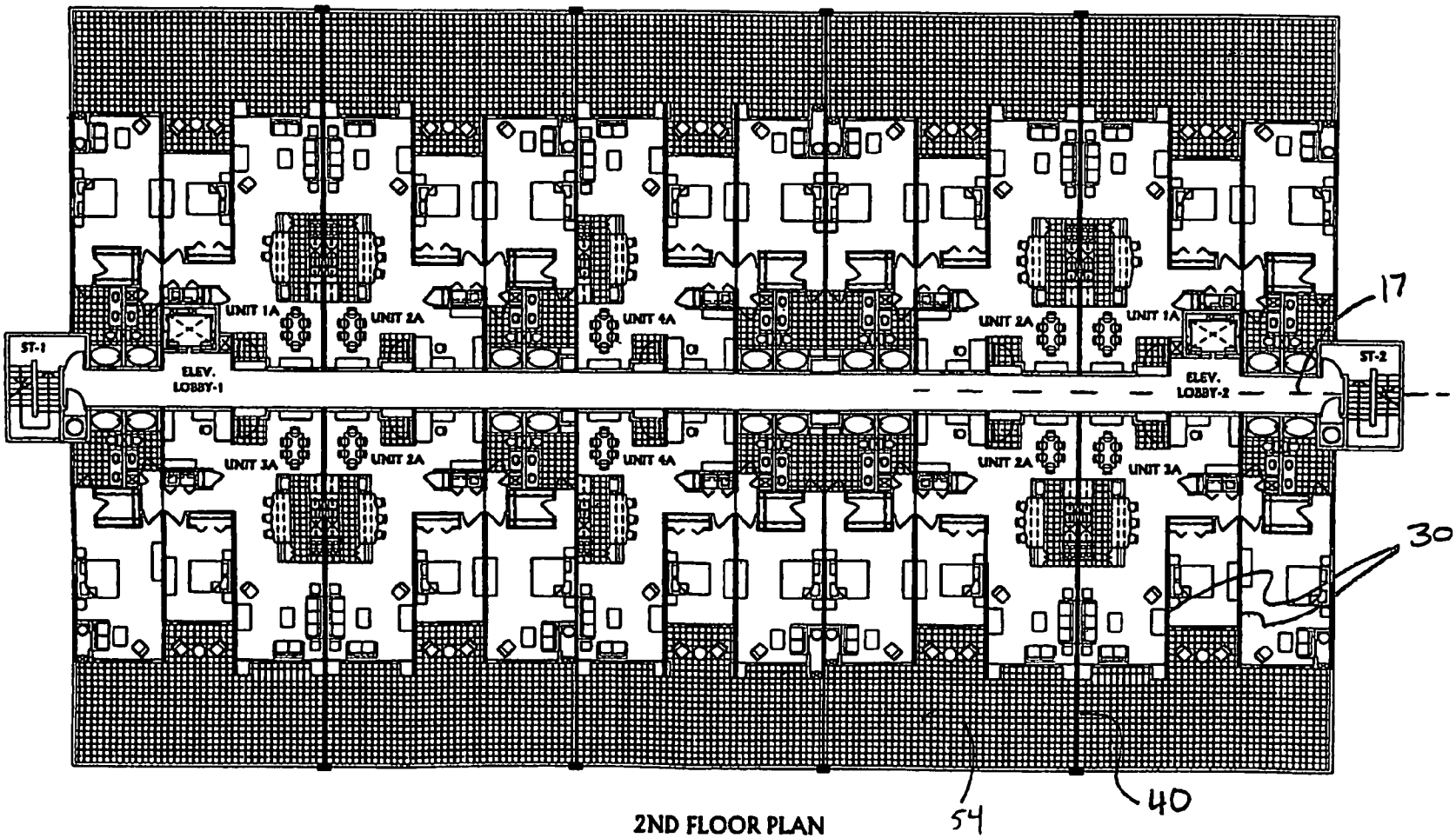
FIG. 2 is a plan view of a representative second floor of the building of FIG. 1 having a superstructure configured as residential units.

Referring now to FIG. 1, the columnar nature of load-bearing members around the perimeter of the parking level can be seen. Specifically, the perimeter of the parking level is provided with a plurality of double-column supports 12 interspersed with a plurality of single-column supports 18. Each double-column support 12 comprises an inner support 14 and an outer support 16. A plurality of inner linear load-bearing members 20 is provided along the main axis 17 of the structure. Referring now to FIG. 2, the interface level, which comprises the lowest level or levels of the upper structure, is provided with a plurality of upper linear load-bearing members 30 interspersed with a plurality of wall beams 40. At their respective inner ends, upper load-bearing members 30 and wall beams 40 are vertically aligned with inner load-bearing members 20. At their respective outer ends, upper linear load-bearing members 30 are vertically aligned with inner supports 14, while wall beams 40 are vertically aligned with single-column supports 18.

Figure 3:
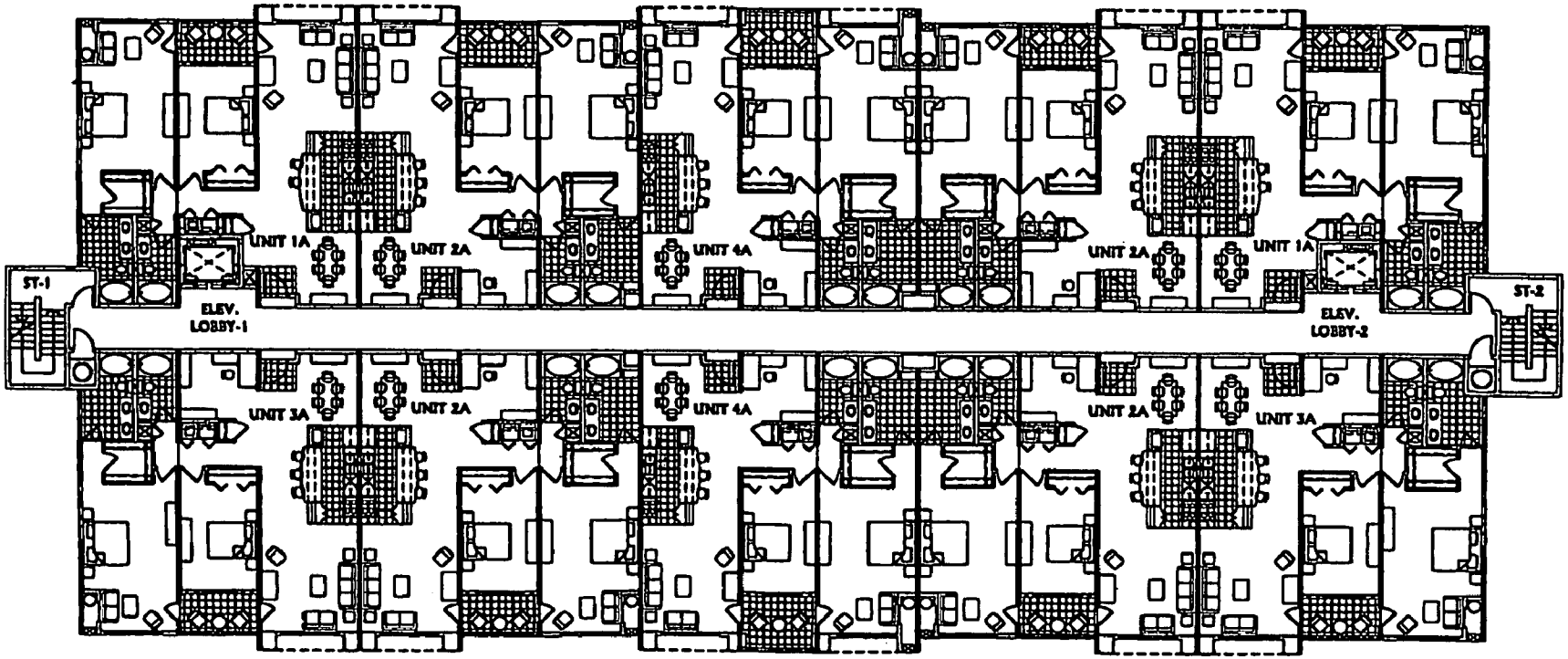
FIG. 3 is a plan view of a representative third floor of the building of FIGS. 1 and 2.

This configuration allows both the parking and residential portions of the structure to be constructed using concrete "tunnels" as are known in the art and disclosed and described in the U.S. Patents mentioned above. The tunnel configuration can be clearly seen in FIG. 4. The use of poured-in-place concrete tunnels reduces the time and cost required for construction. Each tunnel extends from the main axis 17 to the perimeter of the structure, so that each level is formed by a plurality of side-by-side tunnels, which may or may not have identical lengths. As can be seen, the tunnels forming the interface level are as long as the tunnels forming the parking level, FIGS. 1 and 2, while the tunnels forming the levels above the interface level are shorter (FIG. 3). In a preferred embodiment, all but one of the walls of the tunnels forming the interface level is shortened, thereby providing the extending wall beams 40. If desired, only the side walls of the tunnels forming the interface level could be as long as the parking level tunnels. By shortening some of the side walls, a larger, roofless terrace 54 is formed between each extending wall beam 40.

Figure 5:
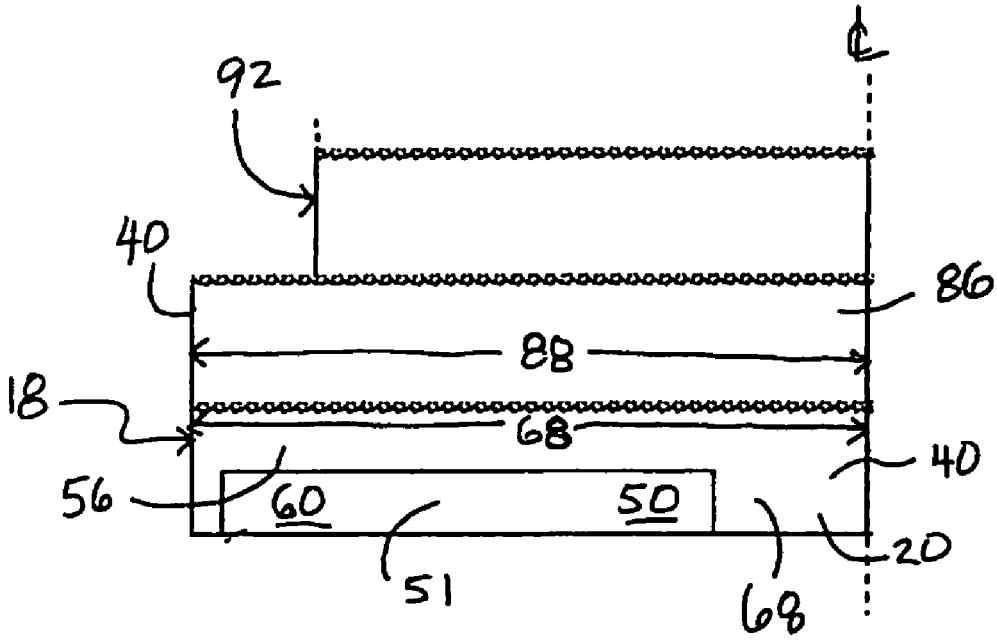
FIG. 5 is an elevation of a section view, taken along section line 5' of FIG. 4, of a structure through a vertical support.
Figure 6:
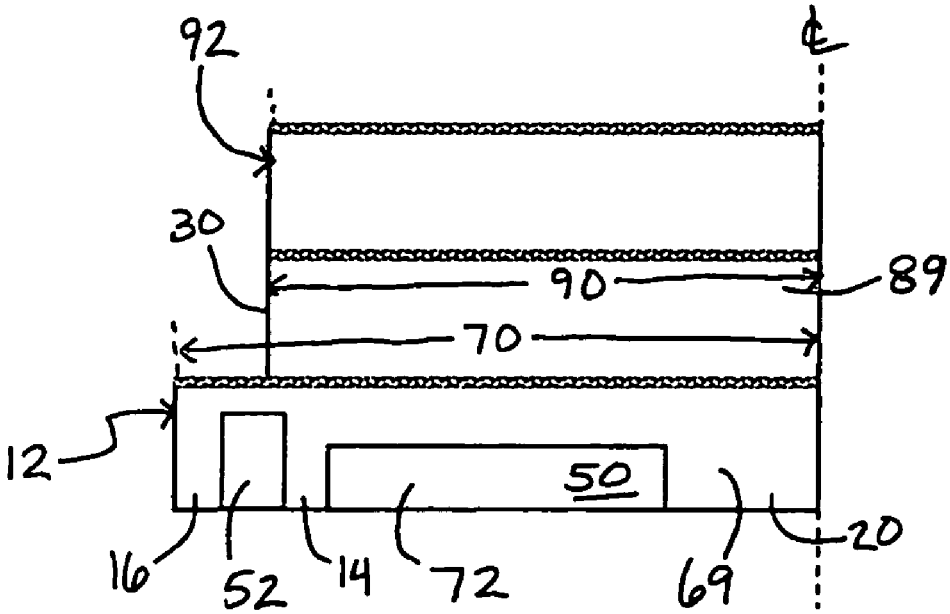
FIG. 6 is an elevation of a section view, taken along section line 6' of FIG. 4, of a structure through another vertical support.

In reference to FIGS. 5 and 6, in a preferred embodiment, the walls between adjacent tunnels on the parking level are opened below each wall beam 40. The opening preferably extends to less than the full height of the tunnel, so that the portion of the wall above the opening forms a beam 56. In certain walls, the opening 51 formed in this manner provides both a drive aisle 50 and an unobstructed three-car bay 60. In other walls, separate openings are left. One opening forms drive aisle 50 and the other opening 52 allows transverse visual access along the bays. Openings 52 can extend from floor to ceiling, if desired, whereas it is preferred that the height of the drive aisle opening be limited so that a beam 58 is left in each tunnel to span drive aisle 50. As is shown in FIG. 1, in one embodiment, it is preferred to alternate one-car bays with three-car bays, resulting in each pair of double-column supports 12 being separated from the next by a single-column support 18 and allowing four parking spaces to be placed in the width of three adjacent tunnels, as best seen in FIG. 1.

Figure 4:
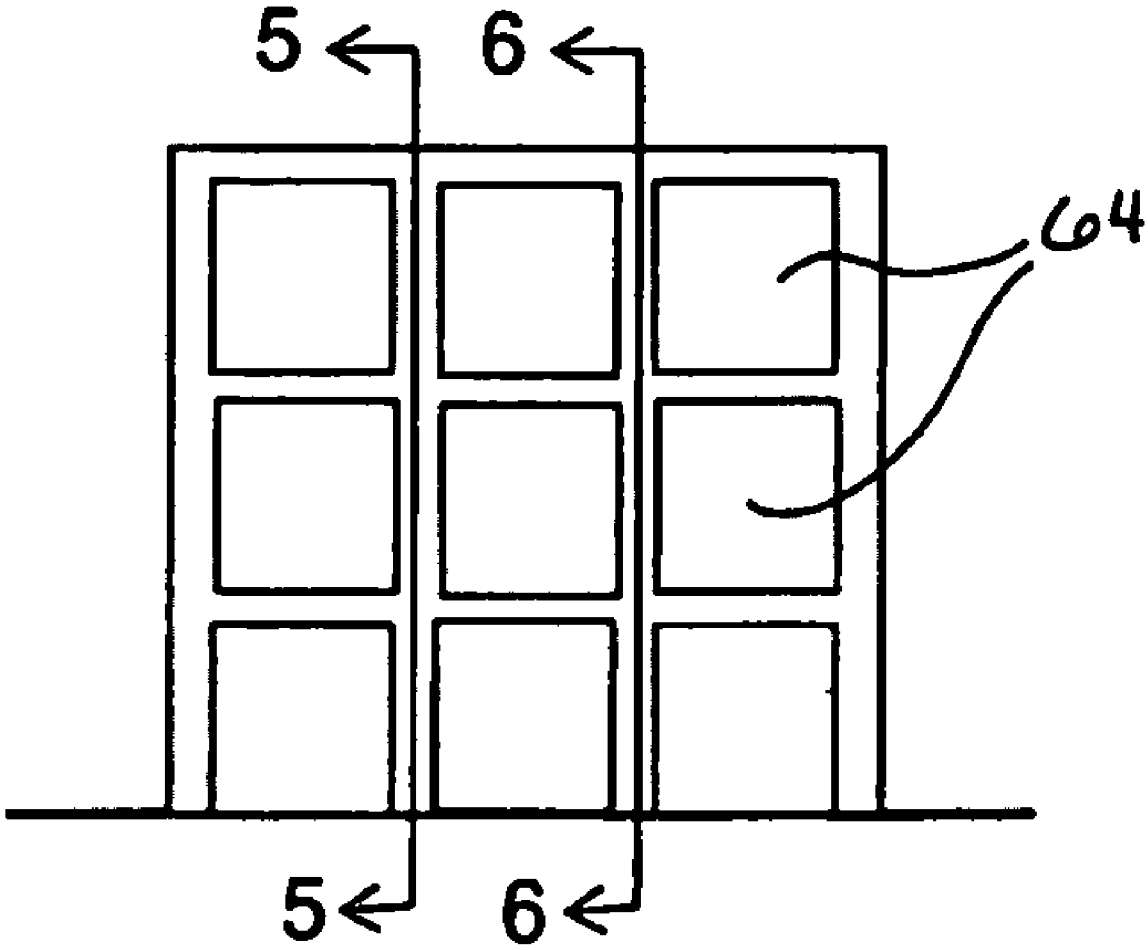
FIG. 4 is an elevation of the building of FIGS. 1-3, illustrating the tunnel configuration.

Thus it can be seen that a building constructed in this manner will have the following features: a substructure including a drive aisle 50 and a plurality of parking spaces 62 and comprising a plurality of parallel, adjacent, poured-in-place tunnels 64 (FIG. 4, shown in phantom in FIG. 1), each tunnel including a transverse drive aisle opening therethrough The substructure preferably includes: a plurality of first tunnel walls 66 each having a first length 68 and a drive aisle opening 51 therethrough (FIG. 5), the drive aisle openings 51 in the first tunnel walls being wide enough to accommodate a parking space in addition to the drive aisle; and a plurality of second tunnel walls 69 each having a second length 70 and a drive aisle opening 72 therethrough (FIG. 6); and a plurality of parking spaces in the substructure, the parking spaces being designated such that a set of three adjacent tunnels 64 includes at least four parking spaces (FIG. 1), with two tunnels encompassing three spaces such that the middle space is centered under the wall between the two tunnels. This feature is illustrated in phantom at 67 in FIG. 1.

The substructure preferably also includes an interface level comprising a plurality of parallel, adjacent, poured-in-place tunnels 64. The interface level includes: a plurality of third tunnel walls 86 vertically aligned with first tunnel walls 66 and having a third length 88, the third length being at least as great as the first length 68, and a plurality of fourth tunnel 89 walls vertically aligned with second tunnel walls 69 and having a fourth length 90.

The present building preferably further includes a superstructure 92 (FIGS. 2, 3, 5) that comprises a plurality of parallel, adjacent, poured-in-place tunnels having walls that are each vertically aligned with one of the first and second tunnel walls.

A system constructed in this manner maximizes the number of parking spaces that can be provided under a separate structure, without necessitating a costly transfer deck. It will be understood that the concepts disclosed herein can be expanded or modified to provide any number of configurations. By opening the side walls of the tunnels and controlling the height of the openings, and providing an interface level that includes spaced wall beams, the versatility of tunnel construction is greatly enhanced.

What is claimed is:

1. A structure having a main horizontal axis and a perimeter, comprising:

a substructure including a drive aisle and a plurality of automobile parking spaces and comprising a plurality of parallel, adjacent, poured-in-place tunnels, each tunnel extending from the main axis to the perimeter of the structure, each tunnel including a transverse drive aisle opening therethrough, said substructure including:

a plurality of first tunnel walls having a first length, said drive aisle openings in said first tunnel walls being wider than the drive aisle openings in other tunnel walls and being wide enough to span an automobile parking space that is perpendicular to the drive aisle in addition to said drive aisle; and a plurality of second tunnel walls having a second length; and a plurality of automobile parking spaces defined in the structure formed by said tunnels, said parking spaces being configured such that a set of three adjacent tunnels includes at least four automobile parking spaces;

an interface level comprising a plurality of parallel, adjacent, poured-in-place tunnels, said interface level including:

a plurality of third tunnel walls vertically aligned with said first tunnel walls and having a third length, said third length being at least as great as said first length; and a plurality of fourth tunnel walls vertically aligned with said second tunnel walls and having a fourth length; and a superstructure comprising a plurality of parallel, adjacent, poured-in-place tunnels having walls that are each vertically aligned with one of said first and second tunnel walls.

2. The structure according to claim 1 wherein said second length is less than said first length.

3. The structure of claim 1 wherein said substructure is a parking garage and said superstructure is residential space.

4. The structure of claim 1 wherein said fourth length is equal to said second length.

5. A structure having a main horizontal axis and a perimeter, comprising:

a substructure including a drive aisle and a plurality of automobile parking spaces and comprising a plurality of parallel, adjacent, poured-in-place tunnels, each tunnel extending from the main axis to the perimeter of the structure, each tunnel including a transverse drive aisle opening therethrough, said substructure including:

a plurality of first tunnel walls having a first length, said drive aisle openings in said first tunnel walls being wider than the drive aisle openings in other tunnel walls and being wide enough to span an automobile parking space that is perpendicular to the drive aisle in addition to said drive aisle; and a plurality of second tunnel walls having a second length;

an interface level comprising a plurality of parallel, adjacent, poured-in-place tunnels, said interface level including:

a plurality of third tunnel walls vertically aligned with said first tunnel walls and having a third length, said third length being at least as great as said first length; and a plurality of fourth tunnel walls vertically aligned with said second tunnel walls and having a fourth length; and a superstructure comprising a plurality of parallel, adjacent, poured-in-place tunnels having walls that are each vertically aligned with one of said first and second tunnel walls.

6. The structure according to claim 5 wherein said first and second tunnel walls are spaced from each other such that three adjacent automobile parking spaces may be defined between two adjacent pairs of second tunnel walls, with said three automobile parking spaces being configured such that a middle one of said three spaces is centered under the first tunnel wall that is disposed between said adjacent pairs of second tunnel walls.

7. The structure according to claim 6 wherein said middle one of said three automobile parking spaces occupies a portion of the drive aisle opening of the first tunnel wall that is disposed between said adjacent pairs of second tunnel walls.

8. A method for constructing a building having a main horizontal axis and a perimeter, comprising:

a) constructing a substructure including a drive aisle and a plurality of automobile parking spaces and comprising a plurality of parallel, adjacent, poured-in-place tunnels, each tunnel including two walls and extending from the main axis to the perimeter of the building, each wall having a transverse drive aisle opening therethrough, by:

i) pouring in place a plurality of first tunnel walls having a first length, said drive aisle openings in said first tunnel walls being wider than the drive aisle openings in other tunnel walls and being wide enough to span an automobile parking space that is perpendicular to the drive aisle in addition to said drive aisle; and ii) pouring in place a plurality of second tunnel walls having a second length;

b) constructing an interface level comprising a plurality of parallel, adjacent, poured-in-place tunnels, each tunnel including two walls, by:

i) pouring in place a plurality of third tunnel walls vertically aligned with said first tunnel walls and having a third length, said third length being at least as great as said first length; and ii) pouring in place a plurality of fourth tunnel walls vertically aligned with said second tunnel walls and having a fourth length; and c) constructing a superstructure comprising a plurality of parallel, adjacent, poured-in-place tunnels having walls that are each vertically aligned with one of said first and second tunnel walls.

9. The method according to claim 8 wherein each of said first and second tunnel walls has an inner end and an outside end and the drive aisle openings in said first tunnel walls extend as far from said first tunnel wall inner ends as the distance between said second tunnel wall inner ends and said second tunnel wall outside ends.

10. The method according to claim 9 wherein each first tunnel wall is separated from another first tunnel wall by a pair of second tunnel walls.

11. The method according to claim 10 wherein said first and second tunnel walls are spaced from each other such that three adjacent parking spaces may be defined between two adjacent pairs of second tunnel wails, with said three parking spaces being configured such that a middle one of said three spaces is centered under the first tunnel wall that is disposed between said adjacent pairs of second tunnel walls.

12. The method according to claim 11 wherein said middle one of said three parking spaces occupies a portion of the drive aisle opening of the first tunnel wall that is disposed between said adjacent pairs of second tunnel walls.

13. The method of claim 8 wherein said drive aisle openings extend to a height less than the full height of the tunnel.

* * * * *